US006077358A

United States Patent [19]

Giersch et al.

[11] Patent Number: 6,077,358

[45] Date of Patent: Jun. 20, 2000

[54] COMPOSITIONS AND METHOD OF TREATMENT OF WHEY

[75] Inventors: Glen J. Giersch, Menomonee Falls; Leo F. Bohanon, Oconomowoc, both of Wis.

[73] Assignee: Hydrite Chemical Co., Milwaukee, Wis.

[21] Appl. No.: 09/216,590

[22] Filed: Dec. 18, 1998

[51] Int. Cl.[7] ..... C13K 5/00

[52] U.S. Cl. ..... 127/31; 127/55; 106/151.1

[58] Field of Search ..... 127/31, 55; 106/151.1

[56] References Cited

U.S. PATENT DOCUMENTS

| | | | |
|---|---|---|---|
| 2,467,453 | 4/1949 | Almy et al. | 127/31 |
| 4,036,999 | 7/1977 | Grindstaff | 426/549 |
| 4,046,686 | 9/1977 | Goldstein | 210/23 |
| 4,163,069 | 7/1979 | Melachouris et al. | 426/582 |
| 4,316,749 | 2/1982 | Evans et al. | 127/55 |
| 4,342,604 | 8/1982 | Evans et al. | 127/31 |
| 5,128,156 | 7/1992 | McKenna et al. | 426/43 |

OTHER PUBLICATIONS

Derwent Acc. No. 1987–278594, "Removal of Lactose from whey . . . ", Jan. 10, 1987.

*Primary Examiner*—David Brunsman
*Attorney, Agent, or Firm*—Quarles & Brady LLP

[57] ABSTRACT

A composition for use as a processing aid in the concentration of whole cheese whey and in the recovery of lactose from cheese whey by a separation process followed by a concentrating process via reverse osmosis filtration or evaporation, wherein, in one embodiment, the composition includes a sodium hexametaphosphate having phosphate chain lengths of 12 to 28 in combination with tetrasodium or tetrapotassium pyrophosphate. In another embodiment, a blend of sodium hexametaphosphate is employed having a phosphate chain lengths of 12 to 14 in one instance and 21 to 28 in another instance. The composition results in increased yields of lactose and an easily removable scale from processing equipment-mainly heat transfer equipment. A method of employing the processing aid composition is also presented.

14 Claims, 1 Drawing Sheet

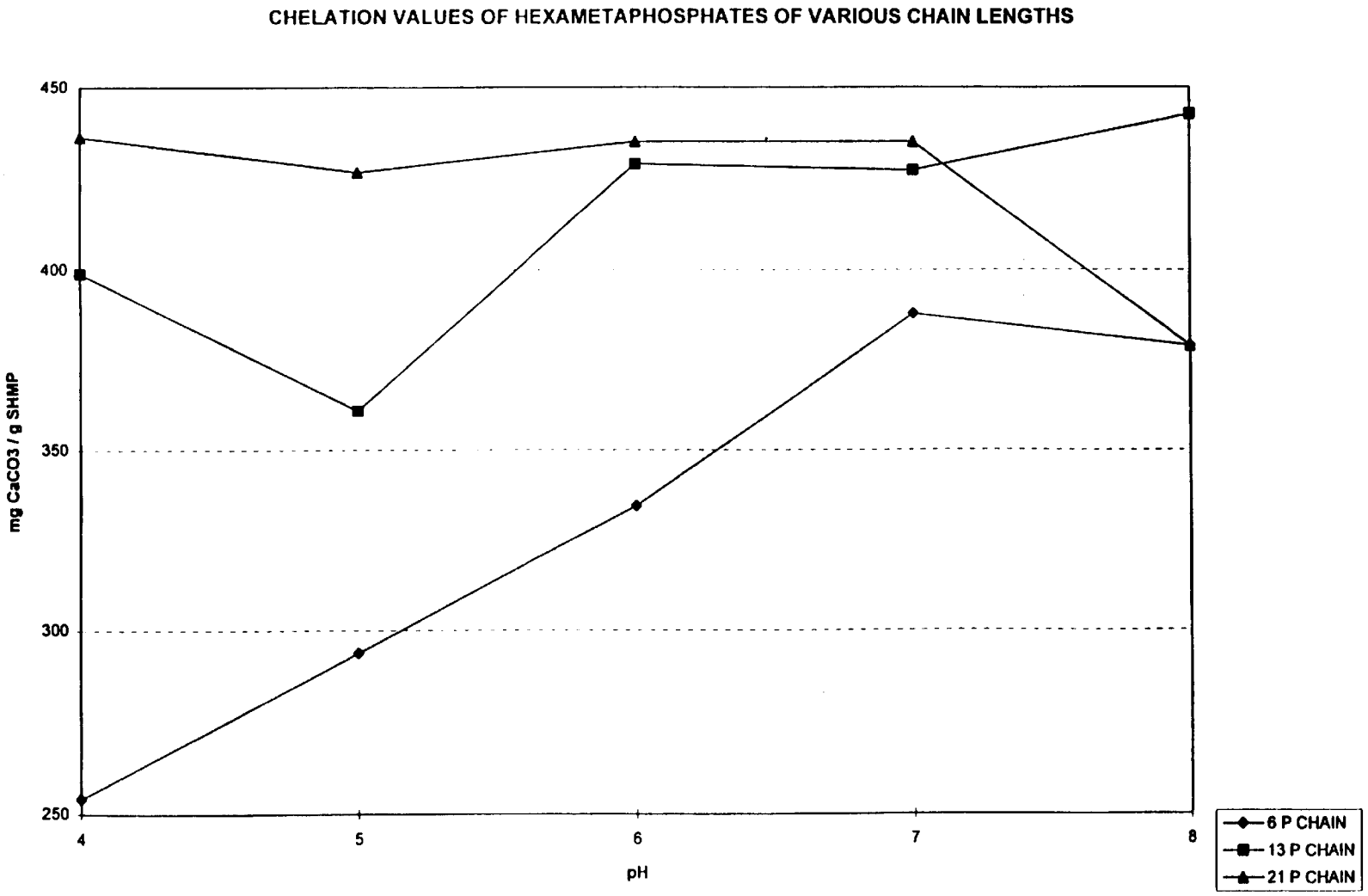
CHELATION VALUES OF HEXAMETAPHOSPHATES OF VARIOUS CHAIN LENGTHS
mg CaCO3 / g SHMP
450
400
350
300
250
4
5
6
7
8
pH
6 P CHAIN
13 P CHAIN
21 P CHAIN

COMPOSITIONS AND METHOD OF TREATMENT OF WHEY

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

The present invention relates to compositions for use as a processing aid in recovering lactose from whey by filtration and evaporation. More particularly, it relates to such compositions composed of sodium hexametaphosphate having polyphosphate chain lengths of 12 to 28 in combination with tetrasodium or tetrapotassium pyrophosphate or a blend of sodium hexametaphosphate wherein the hexametaphosphate is comprised of polyphosphates with a chain length range of 12 to 14 in one instance and 12 to 28 in another.

When calcium and magnesium are present in aqueous solutions, their salts tend to precipitate out of solution onto the surfaces of processing equipment. The salts of calcium and magnesium, especially the carbonate and phosphate salts, become less soluble with increasing temperature, pressure, and pH. The amount of calcium present in whey and/or dairy products can pose a major problem in processing these types of products. As these products come in contact with heated surfaces such as those found in heat exchangers, pasteurizers, and evaporators, the calcium salts become insoluble and create a scale that reduces heat transfer efficiency. In time, this type of scale can become so heavy that it can plug the tubes of an evaporator, the plates of a pasteurizer, and the pores of a filter membrane. Scale build-up equates to shorter production runs, higher energy costs, and more time and chemicals required for cleaning.

Polyphosphates function to prevent excess scale formation by a phenomenon known as the "Threshold Effect". The Threshold Effect is the prevention of precipitation from supersaturated solutions of scalants, such as calcium carbonate and calcium phosphate, by sub-stoichiometric levels of inhibitor. This means that very small doses (ppm levels) of phosphate sequestrants can effectively prevent precipitate formation from solutions that contain large amounts of scalants. Present mechanistic theories postulate that the threshold agent is adsorbed on the growth sites of the scalant crystallite during the process of crystallization. This adsorption alters the growth pattern so that the resultant scalant crystals are formed more slowly and are highly distorted. Obviously, the retardation of crystal growth rate would lower the amount of solid deposited on surfaces needed to be kept scale-free. Secondly, the distortion of crystal structure offers the possibility of different adherence characteristics of that solid formed so that surfaces could have a lower degree of scaling. As previously stated, phosphate sequestrants function to retard scale formation, they do not prevent it.

The use of phosphates in the processing of whey is well known. In U.S. Pat. No. 2,467,453 it is stated that trisodium phosphate, sodium hexametaphosphate, and sodium pyrophosphate are known for stabilizing whey protein. U.S. Pat. No. 4,342,604 discloses hexametaphosphate chain lengths of up to 24 for processing cheese whey to obtain a lactose product. In U.S. Pat. No. 4,342,604 alkali metal polyphosphates having average chain lengths of 2 to 24 are employed to crystallize a lactose product from a cheese whey permeate.

While the use of the previously indicated phosphates have been successfully employed, there is a need for an improved composition and method which can result in a lower ash content for the lactose recovered from cheese whey and, at the same time, more effectively inhibit calcium scale build-up on surfaces of processing equipment and enhance its removal. Further, there is also a need for an improved composition and method which provides chelation of metal ions over a broader pH range as well as the production of more uniform whey and/or lactose crystals. Thus, the need exists for a more efficient composition and method of processing cheese whey and products derived thereof.

SUMMARY OF THE INVENTION

In one aspect, the invention provides a composition for use as a processing aid in recovering lactose from whey by filtration and evaporation. The composition is composed of an aqueous solution of sodium or potassium hexametaphosphate having polyphosphate chain lengths ranging from about 12 to 28 in combination with tetrasodium or tetrapotassium pyrophosphate.

In a preferred embodiment, the sodium or potassium hexametaphosphate has a polyphosphate chain length of 12 to 14 phosphates.

In another preferred embodiment, the ratio of the hexametaphosphate to the pyrophosphate is about 4–20 to about 1 by weight.

In another aspect, there is present a blend of hexametaphosphates with varying phosphate chain lengths. The hexametaphosphates having phosphate chain lengths of about 12 to about 14 are present in an amount of about 0 to 100 weight percent of the hexametaphosphates and the hexametaphosphates having a phosphate chain length of about 21 to about 28 are present in an amount sufficient to make up the remaining hexametaphosphate to 100 weight percent of the total hexametaphosphates in the formulation.

In still another aspect, the hexametaphosphate is sodium hexametaphosphate and is present as a blend of sodium hexametaphosphates with varying phosphate chain lengths. The blend contains sodium hexametaphosphates with a phosphate chain length of 12 to 14 in one instance and a phosphate chain length of about 21 to 28 in another instance. The sodium hexametaphosphates having a phosphate chain length of 21 to 28 are present in an amount of about 1 to 45 weight percent of the hexametaphosphates and the sodium hexametaphosphates having a phosphate chain length of 12 to 14 are present in an amount of 99 to 55 weight percent of the hexametaphosphates.

In yet another aspect, there is provided a method of employing the previously described compositions wherein they are introduced into the whey during a filtration/separation process.

The objects of the invention therefore include:

a) providing a composition for treating cheese whey which results in an improved process and lactose yields.

b) providing a composition of the foregoing type which results in improved lactose recovery and more uniform crystals.

c) providing a composition of the foregoing type which results in a lactose with a low ash content.

d) providing a composition of the foregoing type which effectively retards the build-up of calcium salt scale on heat transfer surfaces and other processing equipment, including reverse osmosis membranes.

e) providing a composition of the foregoing type that greatly reduces the tendency of calcium salt scale to adhere to heat transfer surfaces and other processing equipment by modifying the molecular structure of any calcium salts that do precipitate out of solution.

f) providing a composition of the foregoing type which permits chelation of metal ions over a broader pH range than any other previously documented compositions.

g) providing a composition of the foregoing type which is resistant to phosphate reversion and microbial growth.

h) providing an improved method of recovering lactose from cheese whey.

These and still other objects and advantages of the invention will be apparent from the description which follows. In the detailed description below, a preferred embodiment of the invention will be described in reference to the accompanying drawings. The embodiment does not represent the full scope of the invention. Rather the invention may be employed in other embodiments.

BRIEF DESCRIPTION OF THE DRAWINGS

FIG. 1 is a chart illustrating the chelation values of sodium hexametaphosphates having various phosphate chain lengths.

The following examples are presented to illustrate the compositions and method of this invention. They are not intended to limit the invention in any way.

EXAMPLE 1

This example describes two formulas for the preferred compositions of this invention.

| | Formula I (wt. percent) | Formula II (wt. percent) |
|---|---|---|
| Sodium Hexametaphosphate (SHMP) 12–14 | 22.15 | 38.50 |
| Sodium Hexametaphosphate (SHMP) 21–28 | 2.45 | 4.25 |
| Tetrapotassium Pyrophosphate (TKPP) | 5.40 | 2.25 |
| Sodium Hydroxide | 0.50 | 0.50 |
| Preservative | amount required to inhibit microbial growth* | |
| Water | balance | balance |
| Ratio of SHMP (total) to TKPP: | 4.6:1 | 19:1 |

The sodium hydroxide is added to adjust the pH of the solution to between 7 and 8.5. *The preservative and amount added is governed by FDA-21CFR and/or USDA-9CFR. The addition of sodium hydroxide and preservative function to enhance the shelf life of the product by retarding phosphate reversion and inhibiting mold and other microbial growth, respectively.

The following example describes a preferred manner of employing the processing aids outlined in this invention.

EXAMPLE II

It has been found that the sooner that the products as represented by Formulas I and II can be applied to the process stream (i.e. cheese whey), the greater the chances are that benefits will be realized. In order to achieve the maximum benefit, they should be introduced into the customary process stream prior to exposure to any heat treatment or pH adjustment. Once the process stream is exposed to any increase in heat, pressure, or pH, insoluble calcium salts begin to form and precipitate out of solution, forming scale on surfaces with which that they come in contact. The formulas outlined in Example I operate by inhibiting this precipitation. Once the calcium salts have precipitated, these products have a greatly reduced effectiveness in retarding scale formation. Once such a formulation is added to the process stream, however, it will inhibit and reduce any further precipitation and scale formation. Listed below are common points of addition for the processing aids outlined in Example I.

1 Raw whey storage silos

2 Balance tank after whey clarifier, cream separator, and/or fines saver (before pasteurizer or pre-heater)

3 Lactose permeate balance tank after ultrafiltration unit (common point of addition)

4 Prior to a reverse osmosis filtration unit

5 Balance tank just prior to evaporator distribution plate

6 Lactose crystallizer

In summary, these processing aids can be added anywhere to the process stream that is convenient. However, the best point of addition will be dictated by the desired effects. If a processing aid of this type is added very early on in the process stream, the benefits are likely to be realized throughout the whole system. A rule of thumb is to have the addition point as far upstream from the area of concern as possible. Also, it is not uncommon to use multiple points of addition. For example, if it is desirable to keep an evaporator from prematurely fouling and to produce a purer, more uniform lactose product that dries easier, the processing aid feed flow could be split, adding half of the product before the evaporator and adding the other half to the crystallizer. These products may also enhance the operation of reverse osmosis (RO) type filter membranes that are commonly employed in the concentrating of cheese whey and the lactose derived thereof. Generally, if whey is separated into protein and lactose fractions via an ultra-filtration membrane system (UF), the processing aid should be added to the lactose stream coming off of the UF system. This is due to the fact that the majority of the calcium salts remain with the lactose stream coming off of a UF system.

Tables 1 and 2 set forth below suggest continuous feed rates for the respective Formula I and Formula II products.

TABLE I

SUGGESTED FEED RATE FOR FORMULA I PRODUCT

| POUNDS PER HOUR OF WHEY/LACTOSE PROCESSED | MINIMUM PROCESSING AID FEED RATE (FL OZ./MIN) | MAXIMUM PROCESSING AID FEED RATE (FL OZ./MIN) |
|---|---|---|
| 10,000 | 0.5 | 1.0 |
| 20,000 | 1.0 | 2.0 |
| 30,000 | 1.5 | 3.0 |
| 40,000 | 2.0 | 4.0 |
| 50,000 | 2.5 | 5.0 |
| 60,000 | 3.0 | 5.9 |
| 70,000 | 3.5 | 6.9 |
| 80,000 | 4.0 | 7.9 |
| 90,000 | 4.5 | 8.9 |
| 100,000 | 5.0 | 9.9 |

TABLE II

SUGGESTED FEED RATE FOR FORMULA II PRODUCT

| POUNDS PER HOUR OF WHEY/LACTOSE PROCESSED | MINIMUM PROCESSING AID FEED RATE (FL OZ./MIN) | MAXIMUM PROCESSING AID FEED RATE (FL OZ./MIN) |
|---|---|---|
| 10,000 | 0.29 | 0.57 |
| 20,000 | 0.57 | 1.15 |
| 30,000 | 0.86 | 1.70 |
| 40,000 | 1.15 | 2.30 |
| 50,000 | 1.40 | 2.90 |
| 60,000 | 1.70 | 3.40 |
| 70,000 | 2.00 | 4.00 |
| 80,000 | 2.30 | 4.60 |
| 90,000 | 2.60 | 5.20 |
| 100,000 | 2.90 | 5.70 |

The above feed rates are equivalent to an anhydrous polyphosphate dosage of 75 to 150 PPM by weight into the whey or lactose liquor.

The following Examples III–V illustrate a comparison between other processing aids and that of the present invention.

EXAMPLE III

Whey was taken from a Mozzarella cheese making operation and separated via UF membranes into whey protein concentrate (WPC) and lactose permeate. The lactose solution was concentrated by evaporation to 60% solids, cooled to 70°, and the resultant crystal slurry spray dried. This lactose solution was processed at a rate of 72,000 lbs. per hour for a 14 hour production run.

Without the use of a processing aid, the evaporator and plate-type heat exchanger would start to foul from calcium phosphate scale after 4–6 hours of production. As a result, 8 pounds of citric acid had to be added to the lactose stream in order to de-scale the heat exchanger and evaporator. This citric acid addition had to be performed 2–4 times throughout the course of a 14 hour production run.

In order to help keep the equipment from fouling with calcium phosphate scale, a number of pre-established processing aids were tried. The first processing aid was a 30% solution of straight sodium hexametaphosphate having an average chain length of 13 phosphates. The solution was added to the lactose stream at a rate of 8 fl. oz. per minute as it came off of the UF membrane unit. This had little or no effect on the rate of fouling of the heat exchanger or evaporator. The second processing aid that was tried was a previously patented chelant solution that was developed for blood in a meat processing operation. This processing aid, a mixture of sodium hexametaphosphate, sodium tripolyphosphate, and sodium citrate, was added to the lactose stream at the same point as the first and the dosage rate was also 8 fl. oz. per minute. This second processing aid did not have any observable effect on the fouling of the heat exchanger or evaporator either.

After extensive laboratory research and testing, a blend of SHMP and TKPP was employed as set forth in Formula I of Example I. This solution was successful at retarding the rate of fouling of the heat exchanger and evaporator to such an extent that the system could be run the entire 14 hours without any additions of citric acid or reduction of product processing rate. In fact, with the use of this processing aid, the lactose processing rate was raised from 72,000 lbs. per hour to 90,000 lbs. per hour and the feed rate of the processing aid solution was reduced to 7 fl. oz. per minute.

EXAMPLE IV

In this example, as in Example III, whey is separated into whey protein concentrate (WPC) and lactose solution via a UF membrane system. The lactose solution is then evaporated and dried. This lactose solution is processed at a rate of 69,000 lbs. per hour.

In order to keep the evaporator from fouling and to keep the ash content of the final lactose product low, tetrasodium pyrophosphate (TSPP) was added to the lactose process stream. This material was semi-successful at retarding the calcium phosphate scale formation in the evaporator but did not do much to lower the ash content of the finished lactose powder.

In order to enhance the performance of the evaporator and reduce the ash levels, sodium hexametaphosphate (SHMP) was employed. A 45% solution of SHMP with a phosphate chain length average of 13 was added at a rate of 4.5 fl. oz. per minute. The use of SHMP over TSPP provided for a lower rate of calcium phosphate fouling of the evaporator and a lower ash content of the lactose product. However, the ash content of the product was still not as low as the desired level of 0.15% or less.

Formula II of Example I was then employed. When added at a rate of 3.5 fl. oz. per minute, this solution kept the evaporator cleaner than either SHMP or TSPP used alone, and the ash content of the finished lactose product came in consistently under 0.15%. The scale that did form on the surfaces of the heat transfer equipment was described as "light and fluffy" when compared to the hard "egg shell" like scale that formed when either SHMP or TSPP was used alone. As a result, the evaporator was much easier to clean.

EXAMPLE V

As in Examples III and IV, whey is separated into whey protein concentrate (WPC) and lactose solution via UF membranes. The lactose solution is then evaporated and dried. This lactose solution is processed at a rate of 96,000 lbs. per hour. In order to keep the evaporator clean and produce a high grade, low ash lactose product, a 45% SHMP solution (chain length 12 to 14) was added to the lactose stream. This SHMP solution was added at a rate of 3 gallons per hour.

Subsequently, the same Formula II solution was employed as described in Example III. This resulted in a reduction in the required feed rate of the polyphosphate solution from 3 gallons per hour to 2 gallons per hour, while still achieving the desired results.

EXAMPLE VI

This example illustrates the chelation values of sodium hexametaphosphates with varying chain lengths. The pH range of concern is from 4 to 8 because this is the typical pH range of whey and lactose derived from whey. The hexametaphosphates that were compared were a 6 phosphate chain length, a 12–14 phosphate chain length, and a 21 phosphate chain length. This is illustrated in the graph of FIG. 1. From the graph, it can be seen that the 21 phosphate chain length hexametaphosphate has the highest average chelation capacity over the desired pH range. All values are given as the amount of milligrams of calcium carbonate that each gram of hexametaphosphate can chelate at the specified pH. As can be implied from the graph in FIG. 1, a product that contains a blend of 12–14 phosphate chain length SHMP and a 21 phosphate chain length SHMP will provide a greater chelation capacity over products that contain a single SHMP of a specified phosphate chain length.

While sodium hexametaphosphates have been employed in the foregoing examples, it is obvious that potassium hexametaphosphates could also be used with comparable results.

As described earlier in the paragraph pertaining to the "Threshold Effect" in the background to the invention, polyphosphate sequestrants function to retard scale crystal formation—they do not completely prevent it. It will thus be seen that there is now provided compositions for use in the processing of whey and lactose derived from whey, wherein the calcium phosphate scale that forms while employing such processing aids of the type outlined in this invention is amorphous. By contrast, the scale that forms when sodium hexametaphosphate is used as the sole sequestrant has a rigid "egg shell" like consistency that adheres tightly to equipment surfaces. Because the calcium phosphate scale crystals that form while using the formulations outlined in this invention are amorphous, they do not adhere to the equipment surfaces and are literally "washed" through the system by the process stream. As a result, the rate of scale fouling is greatly retarded and the heat transfer surfaces are much easier to clean. This allows for less energy consumption during processing, longer processing times before necessary descaling of equipment, and for a reduction in the amounts of chemicals and time required for descaling.

In addition to providing more efficient processing of whey, the comparative of this invention also provides the following benefits:

1 Prevents the precipitation of calcium phosphate crystals in concentrated whey and lactose 2 Prevents the coagulation of whey (formation of "whey pudding") in storage or transport tanks 3 Facilitates the drying of whey, whey protein concentrate, or lactose liquor 4 Lowers energy consumption of heat exchange equipment 5 Reduces down time due to fouling 6 Reduces chemical cleaning costs The foregoing invention can now be practiced by those skilled in the art. Such a skilled person will know that the invention is not necessarily restricted to the particular embodiment herein. The scope of the invention is to be defined by terms of the following claims as given meaning by the preceding description.

What is claimed is:

1. A composition for use as a processing aid in the processing of cheese whey and the lactose derived from cheese whey by filtration and evaporation comprising:

an aqueous solution of sodium or potassium hexametaphosphate having phosphate chain lengths of about 12 to about 28 phosphates in combination with tetrasodium or tetrapotassium pyrophosphate.

2. The composition of claim 1, wherein the hexametaphosphate has a phosphate chain length of about 12 to about 14.

3. The composition of claim 2, wherein the ratio of the hexametaphosphate to the pyrophosphate is about 4–20 to about 1 by weight.

4. The composition of claim 1, wherein the hexametaphosphate is present as a blend having about 12 to about 14 phosphate chain lengths in one instance and about 21 to about 28 phosphate chain lengths in another instance.

5. The composition of claim 4, wherein the hexametaphosphates having phosphate chain lengths of about 12 to about 14 are present in an amount of about 0 to 100 weight percent of the hexametaphosphates and the hexametaphosphates having a phosphate chain length of about 21 to about 28 are present in an amount sufficient to make up the remaining hexametaphosphate to 100 weight percent of the total hexametaphosphates in the formulation.

6. The composition of claim 4, wherein the hexametaphosphates are sodium hexametaphosphate and the phosphate chain lengths of about 21 to about 28 are present in an amount of about 1 to 45 weight percent of the hexametaphosphates and the hexametaphosphates having a phosphate chain length of about 12 to about 14 are present in an amount of 99 to 55 weight percent of the hexametaphosphates.

7. The composition of claim 1 further including a tripolyphosphate.

8. The composition of claim 1 further including a preservative.

9. The composition of claim 1 further including an alkaline pH adjusting agent.

10. A method of improving the processing of lactose derived from whey via a filtration process comprising introducing into the whole whey, or lactose solution derived thereof, an aqueous solution of sodium hexametaphosphate having chain lengths of about 12 to about 28 phosphates in combination with tetrasodium or tetrapotassium pyrophosphate.

11. The method of claim 10, wherein the hexametaphosphate has a phosphate chain length of about 12 to about 14.

12. The method of claim 11, wherein the ratio of hexametaphosphate to the pyrophosphate is present in a ratio of about 4–20 to about 1.

13. The method of claim 10, wherein the hexametaphosphate is present as a blend having about 12 to about 14 phosphate chain lengths in one instance and about 21 to about 28 phosphate chain lengths in another instance.

14. The method of claim 13, wherein the hexametaphosphates having phosphate chain lengths of about 12 to about 14 are present in an amount of about 0 to about 100 weight percent of the hexametaphosphates and the hexametaphosphates having a chain length of about 21 to about 28 phosphates are present in an amount sufficient to make up the remaining hexametaphosphate to 100 weight percent of the total hexametaphosphates in the formulation.

* * * * *